US011161215B2

(12) United States Patent
Van Der Veen et al.

(10) Patent No.: US 11,161,215 B2
(45) Date of Patent: Nov. 2, 2021

(54) DOUBLE ROW ABRASIVE DISC

(75) Inventors: Timothy Rolf Van Der Veen, Boronia (AU); Tobias Nilsson, Huskvarna (SE)

(73) Assignee: HUSQVARNA AB, Huskvarna (SE)

( * ) Notice: Subject to any disclaimer, the term of this patent is extended or adjusted under 35 U.S.C. 154(b) by 869 days.

(21) Appl. No.: 13/062,430

(22) PCT Filed: Sep. 1, 2009

(86) PCT No.: PCT/SE2009/000397

§ 371 (c)(1),
(2), (4) Date: May 27, 2011

(87) PCT Pub. No.: WO2010/027312

PCT Pub. Date: Mar. 11, 2010

(65) Prior Publication Data

US 2011/0223845 A1 Sep. 15, 2011

(30) Foreign Application Priority Data

Sep. 5, 2008 (SE) ..... 0801917-6

(51) Int. Cl.
*B24B 7/18* (2006.01)
*B24B 7/22* (2006.01)
(Continued)

(52) U.S. Cl.
CPC ..... *B24B 7/186* (2013.01); *B24B 7/18* (2013.01); *B24B 7/22* (2013.01); *B24B 23/02* (2013.01); *B24B 41/047* (2013.01); *B24D 7/06* (2013.01)

(58) Field of Classification Search
CPC .. B24B 7/18; B24B 7/186; B24B 7/22; B24B 41/047; B24B 23/02; B24D 7/06
(Continued)

(56) References Cited

U.S. PATENT DOCUMENTS 2,425,368 A * 8/1947 Doermann ..... 451/548
3,121,982 A * 2/1964 Miller ..... 451/548
(Continued)

FOREIGN PATENT DOCUMENTS

DE 10032449 A1 1/2002
DE 102004005627 A1 8/2005
(Continued)

OTHER PUBLICATIONS

International Search Report, dated Nov. 24, 2009, pp. 1-4.
Written Opinion of The International Searching Authority, dated Nov. 24, 2009, pp. 1-5.

*Primary Examiner* — Eileen P Morgan
(74) *Attorney, Agent, or Firm* — Burr & Forman, LLP

(57) ABSTRACT

An abrasive disc (2) for grinding and/or polishing hard floor surfaces of stone, concrete or similar, the abrasive disc including a plurality of fixing means (3, 4) for mounting detachably mountable carrier plates (9), each with abrasive elements (11), to a grinding side (2*a*) of the abrasive disc (2), each carrier plate having a specific fixing geometry, characterized by that the fixing means are disposed at least two separate distances from the centre of the disc, first fixing means (3) at a first predetermined distance (r1) and second fixing means (4) at a second predetermined distance (r2), said second predetermined distance (r2) being shorter than the first (r1), so that the carrier plates (9) will be arranged in at least to rows, a first outer row and a second inner row, and each fixing mean (3, 4) includes a groove (7) providing a female coupling adapted for corresponding male couplings of the carrier plates (9).

18 Claims, 4 Drawing Sheets

(51) Int. Cl.
*B24B 23/02* (2006.01)
*B24B 41/047* (2006.01)
*B24D 7/06* (2006.01)

(58) Field of Classification Search
USPC ..... 451/353, 548
See application file for complete search history.

(56) References Cited

U.S. PATENT DOCUMENTS

| | | | | | |
|---|---|---|---|---|---|
| 3,464,166 | A * | 9/1969 | Bouvier | B24D 13/14 | 451/548 |
| 3,517,466 | A * | 6/1970 | Bouvier | 451/490 |
| 5,076,023 | A * | 12/1991 | Saguchi | 451/540 |
| 5,247,765 | A * | 9/1993 | Quintana | 451/548 |
| 5,567,503 | A * | 10/1996 | Sexton et al. | 428/143 |
| 5,586,930 | A * | 12/1996 | Hayashi et al. | 451/548 |
| 6,196,911 | B1 * | 3/2001 | Preston et al. | 451/548 |
| 6,814,657 | B2 | 11/2004 | Spangenberg et al. | |
| 7,147,548 | B1 | 12/2006 | Mehrabi | |
| 7,687,569 | B2 | 3/2010 | Glöckner et al. | |
| 2005/0164620 | A1 * | 7/2005 | Amamoto | 451/548 |
| 2007/0254568 | A1 * | 11/2007 | Park | 451/548 |
| 2007/0292207 | A1 * | 12/2007 | Reed et al. | 404/112 |

FOREIGN PATENT DOCUMENTS

| | | | |
|---|---|---|---|
| EP | 1319471 | A1 | 6/2003 |
| EP | 1638731 | B1 | 10/2007 |
| FR | 2131299 | A5 | 11/1972 |
| WO | 2006003044 | A1 | 1/2006 |
| WO | 2007011289 | A1 | 1/2007 |

* cited by examiner

DOUBLE ROW ABRASIVE DISC

TECHNICAL FIELD

The present invention relates to an abrasive disc for grinding and/or polishing hard floor surfaces of stone, concrete or similar, the abrasive disc including a plurality of fixing means for mounting detachably mountable carrier plates, each with abrasive elements, to a grinding side of the abrasive disc, each carrier plate having a specific fixing geometry.

BACKGROUND ART

Rotatably mounted discs supporting abrasive elements are commonly used when grinding stone and concrete floors. In particular abrasive discs with a number of detachably mounted carrier plates each holding abrading elements have become popular. Patents EP1638731, U.S. Pat. No. 7,147,548, and WO2006/03044 are examples of abrasive discs with detachably mounted carrier plates.

By having detachably mounted carrier plates the abrasive elements can be easily exchanged reducing the total costs and increasing the flexibility in relation to having carrier plates with fixed abrading elements. Different floors may have different properties, for instance hardness, porosity, material composition. This may affect the optimal setup of abrading elements and even if an operator uses an abrasive disc with detachably mounted carrier plates, the operator sometimes have to find a good enough compromise. Therefore it would be desired if even more flexibility could be achieved.

Another problem that can arise when grinding with discs is that when turning off the machine the abrasive disc may cause circular grinding-tracks in the ground, which of course is undesirable.

DISCLOSURE OF THE INVENTION

It is an object of the present invention to solve the above mentioned problems, which is accomplished through an abrasive disc for grinding and/or polishing hard floor surfaces of stone, concrete or similar, the abrasive disc including a plurality of fixing means for mounting detachably mountable carrier plates, each with abrasive elements, to a grinding side of the abrasive disc, wherein the fixing means are disposed at least two separate distances from the centre of the disc, first fixing means at a first predetermined distance and second fixing means at a second predetermined distance, said second predetermined distance being shorter than the first, so that the carrier plates will be arranged in at least two rows, a first outer row and a second inner row.

Preferably each fixing mean includes a groove providing a female coupling adapted for corresponding male couplings of the carrier plates, and the first predetermined distance is a distance to a position where the grove of the first fixing means has a specific mating width for cooperation with a male coupling, and the second predetermined distance is a distance to a position where the grove of the second fixing means has the same specific mating width for cooperation with a male coupling.

The described arrangement of said fixing means enables for an enhanced flexibility in the placement of said carrier plates, leading to the possibility of using the same disc for many different configurations; an advantageous feature when adapting the abrasive disc to various types of grounds to be worked upon. It has also been observed that the use abrasive elements placed at more than one predetermined distance from the center of the disc could reduce the occurrence of circular grinding tracks in the ground.

According to one aspect of the invention each of said fixing means preferably includes a groove in the abrasive disc, which groove preferably has a conical shape where a base of said conical shape facing the center of the disc is wider than a tip located at or closer towards the outer circumference of the disc.

The shape of said groove will lead to that a carrier plate being attached therein upon rotation of an abrasive disc is pushed radially outwards from the center of said disc, which will have a wedging effect on the attachment of said carrier plate.

According to yet another aspect of the invention, each of said grooves has two side walls propagating outwards, which side walls each preferably inclines outwardly from the front side, (the side of a disc facing the ground when abrading), of the abrasive disc towards the opposite side. Carrier plates with gripping means adapted in shape to said groove will be easily attached and retained by the inclination of the side walls during the grinding process.

According to yet another aspect of the invention, in a preferred way each of said fixing means at the first predetermined distance to the center of a disc is disposed circumferentionally in between two adjacent fixing means at the second predetermined distance. Every second of the fixing means around the periphery of a grinding disc belongs to said first predetermined distance, and every second to said second predetermined distance.

Furthermore, the number of fixing means at the second predetermined distance is equal to the number of fixing means at the first predetermined distance.

Described disposition of said fixing means will lead to a maximal use of the disc area, and will further lead to numerous possibilities in configurations depending on what number of fixing means are used, and which ones that are used for mounting carrier plates.

Preferably, the number of fixing means at each distance exceeds six, preferably exceeds eight, but more preferably exceeds ten. Moreover, the fixing means are distributed evenly around the disc. An even distribution of fixing means is preferred on order to achieve a balanced disc during grinding.

DETAILED DESCRIPTION OF THE DRAWINGS

The abrasive disc will hereinafter be described in more detail with reference to the accompanying drawings. The following descriptions should be considered as preferred forms only, and are not decisive in a limiting sense.

Figure 1:
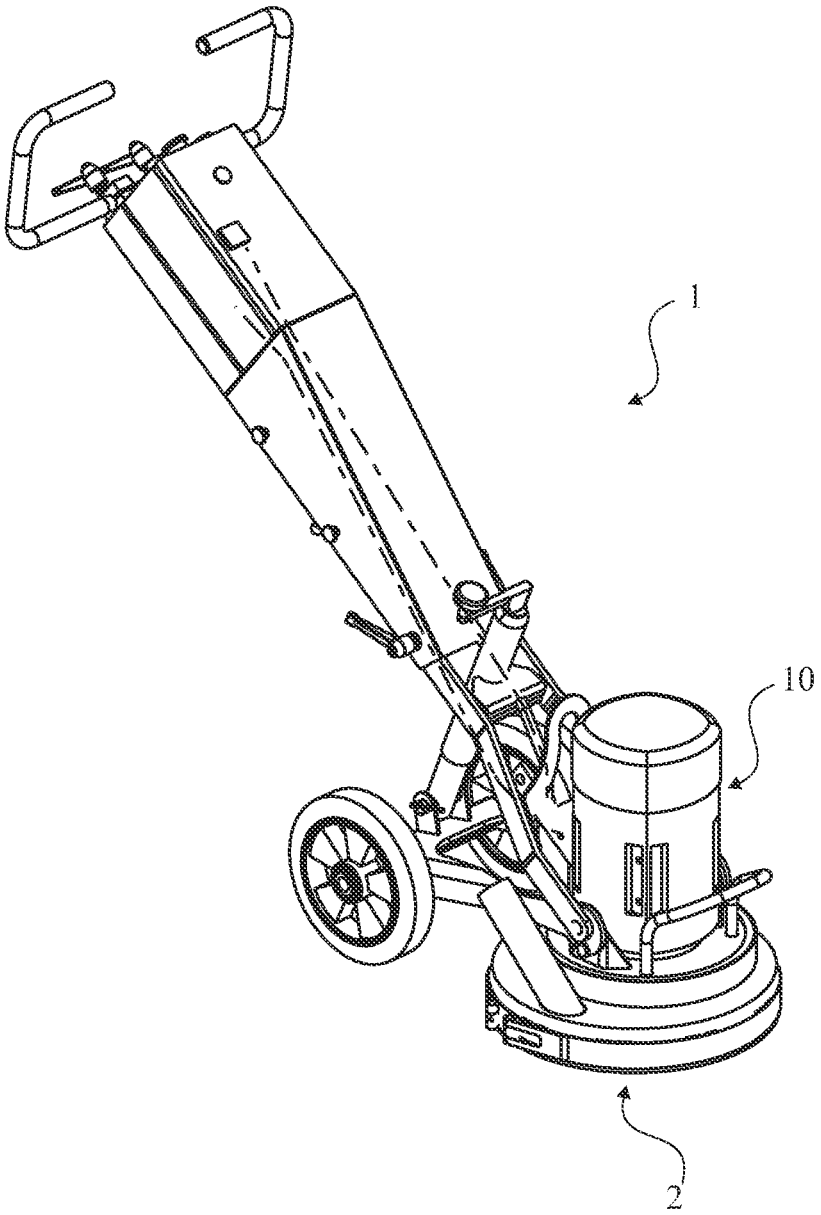
FIG. 1 shows a mobile grinding machine.
Figure 2B:
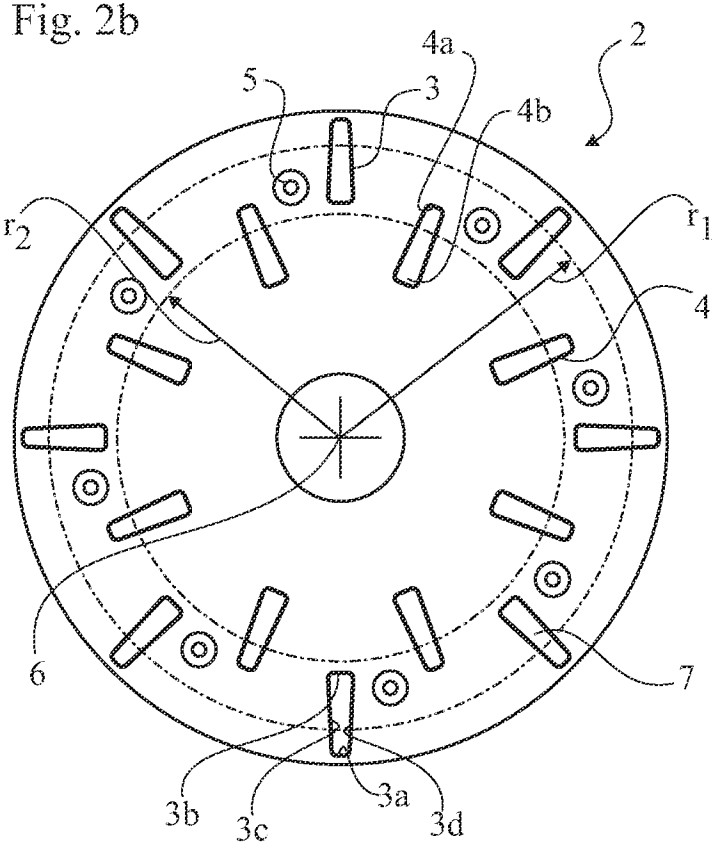
FIG. 2*b* shows another example of an abrasive disc according to the invention.
Figure 2A:
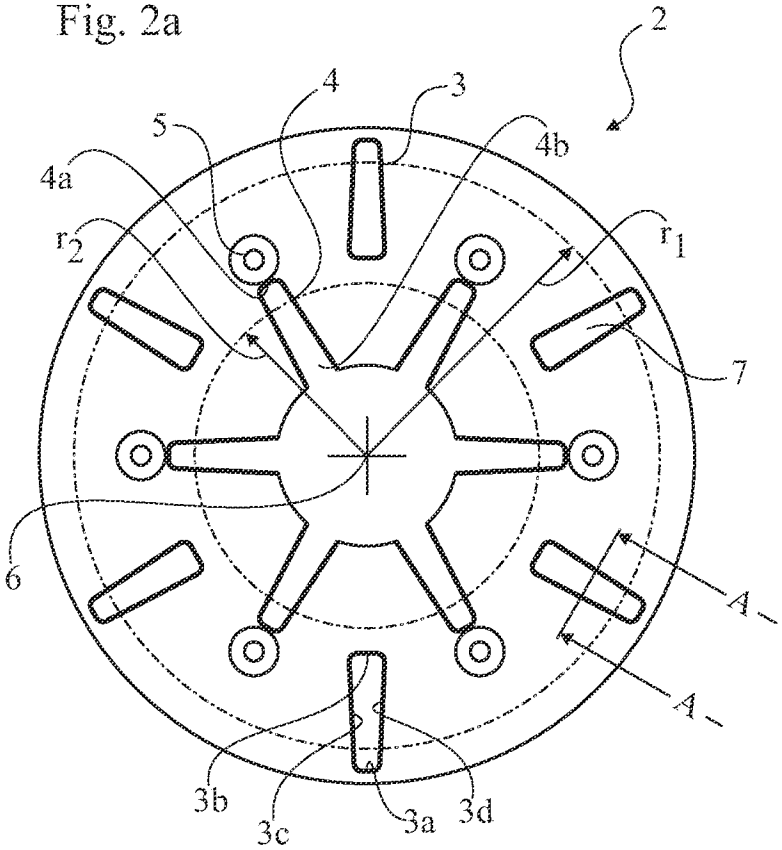
FIG. 2*a* shows an abrasive disc according to the invention with double rows of fixing means.

FIG. 1 shows a mobile grinding machine 1. The mobile grinding machine 1 has an engine 10 which drives at least one abrasive disc 2 facing the floor to be grinded. The mobile grinding machine 1 can be of planetary type with a plurality of abrasive discs as e.g. Husqvarna PG 820 or having a single abrasive disc as e.g. Husqvarna MP 250 S. FIGS. 2*a* and 2*b* show two examples of abrasive discs 2 according to the invention, having two sets of fixing means 3, 4 in the form of radially extending grooves 7, where the fixing means 3, 4 include at least two first fixing means 3 distributed around the centre of the disc at a first predetermined distance r1 to the centre thereof, and at least two second fixing means 4 distributed around the centre of the disc at a second predetermined distance r2 to the centre thereof, where r1>r2.

The fixing means 3, 4 in the form of radially extending grooves 7 are for mounting detachably mountable carrier plates 9 with abrasive elements 11 (see FIG. 4) on a front side 2*a* of the abrasive disc.

The abrasive disc 2 has a front side 2*a* and a back side 2*b*, which front side is facing the ground during the grinding process. The abrasive disc 2 further has a circular opening 6 in the center to guide the disc when attaching it to the grinding machine 1. A plurality of screw holes 5 are situated around the abrasive disc 2 to be used for tightening of the abrasive disc 2 when put into place in a grinding machine.

Each groove 7 is preferably of a conical shape tapering radially outwards from the center of the disc. The grooves 7 are evenly distributed around the circumference of the disc. It is possible that two carrier plates 9 will be attached to a first 3 and a second 4 fixing mean in such a way that the abrasive elements 11 of respective carrier plate will overlap radially. This could be accomplished in that the grooves of first 3 and second 4 fixing means might be distributed so that the innermost end 3*b* of the first fixing means 3 and the outermost end 4*a* of the second fixing means 4 partly overlap each other in the radial direction, as illustrated in FIG. 2*b*.

It is obvious, however, that the fixing means 3, 4 can be arranged so that the innermost end 3*b* of the first fixing means is more distant from the center than the outermost end 4*a* of the second fixing means, so that they do not overlap in the radial direction.

In a preferred way, the innermost second fixing means 4 are disposed circumferrally in between two adjacent outermost first fixing means 3 in such a way that the first and the second fixing means will not extend along the same radial line. The arrangement is shown in FIG. 2*a* and FIG. 2*b*.

In FIG. 2*a*, the grooves 7 of the innermost second fixing means 4 are placed in such a way that the innermost end 4*b* of each fixing mean opens up toward the opening at the center of the disc 6, while in FIG. 2*b* both the first 3 and the second 4 fixing means form separate, closed grooves 7.

In the shown example of FIG. 2*a* the disc 2 comprises six first fixing means 3 and six second fixing means 4 while the disc of FIG. 2*b* comprises eight of each. However, it is clear to a person skilled in the art that one disc could comprise anywhere from two or more fixing means sharing the same predetermined distance to the center of the disc 2.

Moreover, an abrasive disc according to the invention could comprise more than two fixing means, preferably distributed evenly around an abrasive disc to balance the disc, and each having a certain predetermined distance to the center of a disc that is different from the distance of any other fixing means on the same disc.

In the shown examples the fixing means 3, 4 has been shown in the form of grooves 7, however the skilled person realizes that other fixing means could be used, such as e.g. a protrusion of the disc 2 and a mating groove in the carrier plate 9.

Figure 3A:
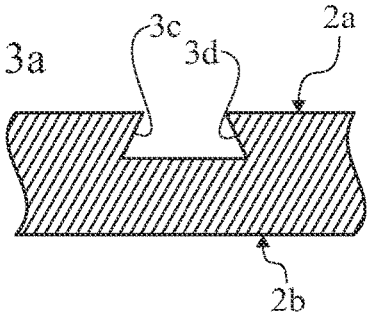
FIG. 3*a*-3*h* shows examples of cross sections for the fixing means of the abrasive plate.

FIG. 3*a* is an example of a cross section, for instance taken along the line A-A of FIG. 2*a*, showing an example of a fixing mean 3 in the form of a groove 7. The fixing mean 3 has two inner walls 3*c*, 3*d* propagating radially, which inner walls each preferably inclines outwardly from the front side 2*a* of the abrasive disc towards the back side 2*b*, the front side being the side of the abrasive disc 2 facing the ground during the grinding process. As is illustrated in FIG. 3*a*, said fixing mean extends only partly through the entire thickness of the grinding disc 2, and said grooves are facing the front side 2*a* of an abrasive disc, leaving the back side 2*b* unaffected. Of course this groove can also be arranged to reach the outer perimeter of the disc 2, at least for the outer row of fixing means 3. This could possibly apply also for the design of FIGS. 3*b*, 3*c*, 3*e*, 3*f* and 3*g* described below.

Figure 3B:
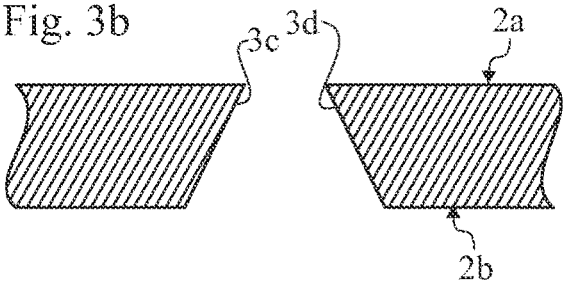

FIG. 3*b* is another example of a cross section taken along the line A-A of FIG. 2*a* showing a fixing mean 3 in the form of a groove 7, in this case a groove that is extending through the entire thickness of the grinding disc 2. The two inner walls 3*c*, 3*d* of said fixing mean have an inclination of the same kind as in the example given in 2*b*.

Figure 3C:
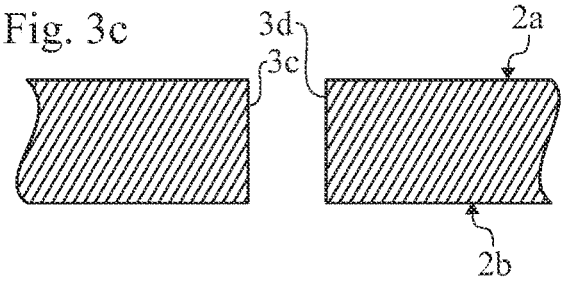

FIG. 3*c* is yet another example of a cross section taken along the line A-A of FIG. 2*a* showing a fixing mean 3 in the form of a groove 7. Here, the inner walls 3*c*, 3*d* of said fixing mean are right-angled from the front side 2*a* of the abrasive disc towards the back side 2*b*. Obviously the inner walls could also be right angled in two steps giving a wider groove entering side 2*b*.

Figure 3D:
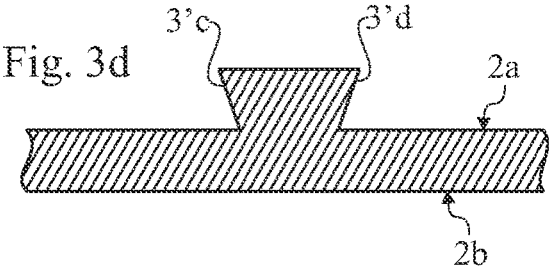
Figure 3E:
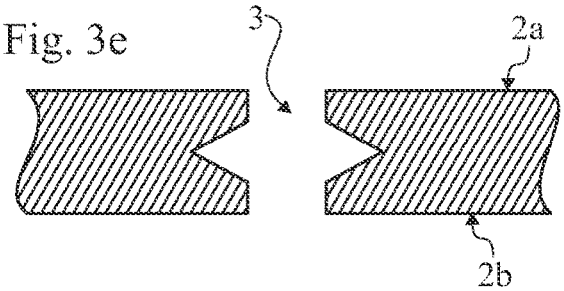
Figure 3F:
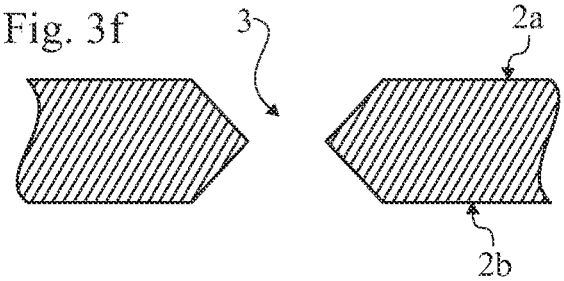
Figure 3G:
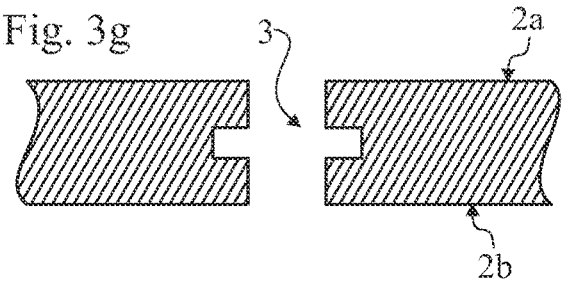

FIG. 3*d* is another example of a cross section of a fixing mean, here in the form of a protrusion on the front side 2*a* of an abrasive disc 2. Said protrusion preferably has radially propagating side walls 3'*c*, 3'*d* and has a conical shape in the same way as previously described grooves. Each of the side walls 3'*c*, 3'*d* preferably inclines outwards and upwards from the front side 2*a* of the abrasive disc.

A fixing mean in the form of a protrusion as shown in FIG. 3*d* will have a corresponding carrier plate with a groove that mates the form of said protrusion.

FIG. 3 *e-g* shows alternative examples of fixing means 3 in the form of grooves, which grooves each has side walls shaped to enable fastening of a matching carrier plate. Two of the fixing means comprise pitted side walls (FIGS. 3*e*, 3*g*), and one of the fixing means comprise protruding side walls (FIG. 3*f*).

Figure 3H:
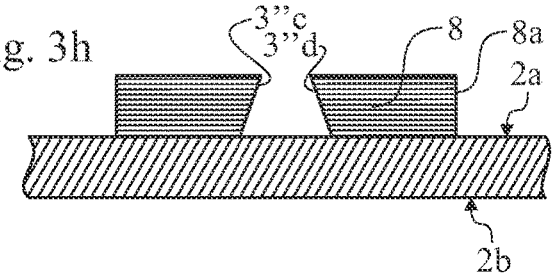

FIG. 3*h* is a cross section showing an example of a fixing mean on an abrasive disc 2 wherein a groove 7 is formed in between by opposing brackets 8 mounted onto the grinding side 2*a*. Said groove has two inner walls 3"*c*, 3"*d* propagating outwards in the disc 2, wherein said walls inclines outwardly from the top side of the brackets towards the front side 2*a* of the abrasive disc. The outer side 8*a* of each bracket could either constitute the end of said bracket, or form the inner wall of a groove belonging to the next fixing mean. In the latter case, said outer side 8*a* would have an inclination of the same kind as the inner walls 3"*c*, 3"*d* of the first groove.

It is understood that the embodiments of the cross section of the fixing mean as shown in FIG. 3*a*-3*h* are applicable to any fixing mean 3, 4 at any predetermined distance from the center of an abrasive disc 2.

Figure 4:
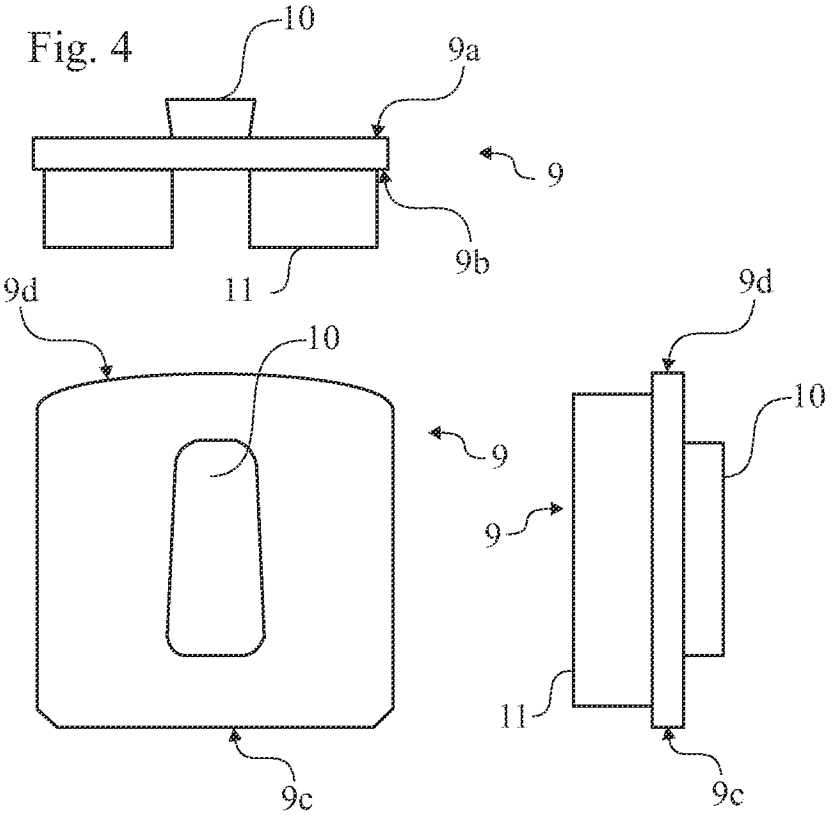
FIG. 4 shows an example of a carrier plate for abrasive elements seen from one of the short ends, from below and from a side respectively.

FIG. 4 shows an example of a carrier plate 9 for abrasive elements 11 seen from one of the short ends, from below and from a side respectively. The carrier plate 9 has an underside 9*a* and a top side 9*b*, on which underside a radial gripping member 10 is fastened. The gripping member 10 preferably extends along a path from the innermost end 9*c* to the farthest out end 9*d* at the underside 9*a* of said carrier plate 9, and has a somewhat conical shape with the base towards said innermost end and the tip towards said farthest out end. The gripping member 10 further has two side walls which preferably has an inclination outwards and upwards from the surface of the carrying plate 9. Said inclination is arranged to mate with the inclination of fixing means 3, 4 in an abrasive disc 2. The length of the carrier plate 9 is made shorter than the length of a fixing mean 3, 4 in an abrasive disc 2.

When attaching a carrier plate 9 according to FIG. 4 onto an abrasive disc 2, the abrasive disc is first put down with its front side 2*a* turned upwards exposing the grooves of the fixing means 3, 4. One of the grooves 7 of the abrasive disc is chosen for mounting a carrier plate, and the gripping member 10 of a carrying plate is placed into the wider part of said subjacent groove with the innermost end 9*c* of said carrying plate 9 pointing towards the centre of the abrasive disc 2. The carrying plate is subsequently radially pulled toward the outermost narrower portion of said groove 3*a*, 4*a*, thus fixing the carrying plate by means of co-operation between the mating groove and the gripping member of said carrying plate.

The exchange of carrying plates as described above takes very little time, and is easy to perform.

A fastened carrying plate will expose its top side 9*b* with thereto belonging abrasive elements 11 on the front side 2*a* of the abrasive disc 2. When in use the abrasive disc will be mounted into a grinding machine 1, front side and the attached abrasive elements facing the surface to be grinded. Upon rotation of the disc the centrifugal force will press the carrier plates 9 toward the outer periphery of the abrasive disc, thus enforcing the fixation of said carrier plates onto the abrasive disc.

Figure 5:
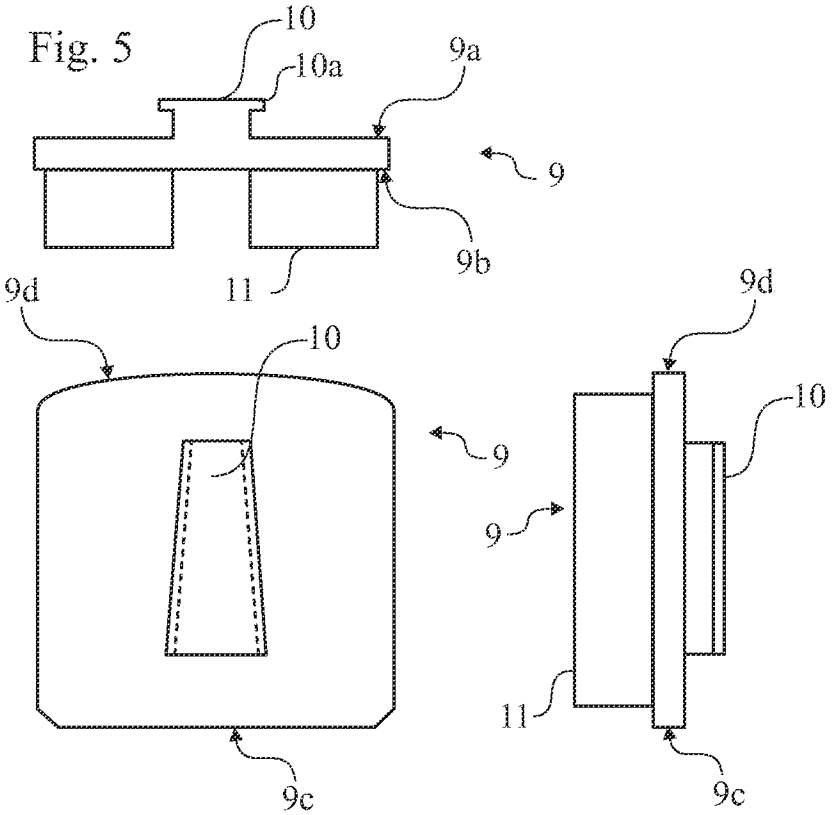
FIG. 5 shows another example of a carrier plate for abrasive elements seen from one of the short ends, from below and from a side respectively.

FIG. 5 shows another example of a carrier plate 9 for abrasive elements 11 seen from one of the short ends, from below and from a side respectively. The gripping member 10 has right-angled side walls and is formed with brims 10*a* stretching along each of the sides from the innermost end 9*c* to the farthest out end 9*d* of the carrier plate. Shown embodiment will match a fixing mean shown in FIG. 3*c*, where said fixing mean in the form of a groove will have right-angled inner walls.

When fastening the carrier plate 9 into a groove 7 of an abrading disc 2 as described in FIG. 5, said brims 10*a* will have a gripping effect around the walls of such a groove keeping the carrier plate in place during the grinding process.

It is understood that the carrying plate 9 could vary in appearance and composition. For instance, each carrying plate 9 might support one or more units of abrasive elements 11. Further, the gripping member 10 might vary in length and/or width, or it might have another inclination than herein described. Modifications and adaptations of the equipment are feasible, without departing from the protection area as defined by the following claims.

The invention claimed is:

1. A disc comprising: a plurality of fixing means for mounting detachably mountable carrier plates, each carrier plate with abrasive elements, to a grinding side of the disc, each fixing means having a specific fixing geometry; and a plurality of at least four securing holes configured to receive a fastener for tightening the disc onto a grinding machine, the securing holes being positioned symmetrically about the disc; wherein the plurality of fixing means comprise a first set of a plurality of at least four fixing means and a second set of a plurality of at least four fixing means: the first set of fixing means disposed at a first outer row at a first predetermined radial distance from a center of the disc that passes through each of the first set of fixing means, and the second set of fixing means disposed at a second inner row at a second predetermined radial distance from the center of the disc that passes through each of the first set of fixing means, said second predetermined distance being shorter than the first predetermined distance; wherein each fixing means of the first and second sets of fixing means includes an elongated groove in the disc extending through an entire thickness of the disc; wherein each elongated groove extends through the entire thickness of the disc and comprises a first end facing the outer circumference of the disc, a second end opposite the first end and facing the center of the disc, a first sidewall, and a second sidewall; wherein the first set of fixing means and the second set of fixing means have an equal number of elongated grooves disposed equidistant around the disc; each elongate groove of each fixing means of the second set of fixing means extending in a direction from the center toward an outer circumference of the disc that bisects a circular arc length between the two closest elongate grooves of the fixing means of the first set of fixing means, the circular arc length being disposed along a circle defined by the first predetermined radial distance; and wherein the second end of at least one groove of the second set of fixing means is open into an opening at the center at the disc, wherein each securing hole is positioned to bisect two adjacent elongated grooves of the first set of fixing means, and each securing hole is positioned near the first end of a respective elongated groove of the second set of fixing means; and wherein each securing hole is diametrically opposed to another securing hole through the center of the disc.

2. The disc according to claim 1, wherein the first predetermined distance is a distance to a position where the groove of the first set of fixing means has a specific mating width for cooperation with a male coupling, and the second predetermined distance is a distance to a position where the groove of the second set of fixing means has the same specific mating width for cooperation with a male coupling.

3. The disc according to claim 1, wherein each of the first side wall and the second sidewall propagate outwards from the front side of the disc towards a Pack side of the disc.

4. The disc according to claim 1, wherein each groove of the first and second sets of fixing means is formed between opposing brackets arranged to protrude from the grinding side.

5. The disc according to claim 1, wherein a number of fixing means within the first set of fixing means exceeds six and a number of fixing means within the second set of fixing means exceeds six.

6. The disc according to claim 1, wherein the second end of each groove of the first set of fixing means is closed, and wherein the second end of each groove of the second set of fixing means opens up into the opening at the center of the disc.

7. The disc according to claim 1, wherein no two fixing means of the disc extend along a same radial line from the center.

8. A disc comprising: a plurality of fixing means for mounting detachably mountable carrier plates, each carrier plate with abrasive elements, to a grinding side of the disc, each fixing means having a specific fixing geometry; and a plurality of at least four securing holes configured to receive a fastener for tightening the disc onto a grinding machine, the securing holes being positioned symmetrically about the disc; wherein the plurality of fixing means comprise a first set of a plurality of at least four fixing means and a second set of a plurality of at least four fixing means: the first set of fixing means disposed at a first outer row at a first predetermined radial distance from a center of the disc that passes through each of the first set of fixing means, and the second set of fixing means disposed at a second inner row at a second predetermined radial distance from the center of the disc that passes through each of the first set of fixing means, said second predetermined distance being shorter than the first predetermined distance; wherein each fixing means of the first and second sets of fixing means includes an elongated groove in the disc extending through an entire thickness of the disc; wherein the first set of fixing means and the second set of fixing means have an equal number of elongated grooves disposed equidistant around the disc, each elongate groove of each fixing means of the second set of fixing means extending in a direction from the center toward an outer circumference of the disc that bisects a circular arc length between the two closest elongate grooves of the fixing means of the first set of fixings means, the circular arc length being disposed along a circle defined by the first predetermined radial distance; wherein each elongated groove is defined by a first sidewall and a second sidewall extending through the entire thickness of the disc; wherein a slope of the first sidewall extends in a first direction over a first portion of the first sidewall and changes to a second direction over a second portion of the first sidewall; wherein a slope of the second sidewall extends in the second direction over a first portion of the second sidewall and changes to the first direction over a second portion of the second sidewall wherein each securing hole is evenly spaced between an adjacent elongated groove of the first set of fixing means and an adjacent elongated groove of the second set of fixing means; and wherein each securing hole is diametrically opposed to another securing hole through the center of the disc.

9. The disc according to claim 8, wherein the first portion of the first sidewall and the first portion of the second sidewall extend from a first face of the disc to a middle of the disc, and wherein the second portion of the first sidewall and the second portion of the second sidewall extend from a second face of the disc to the middle of the disc.

10. The disc according to claim 8, wherein the first portion of the first sidewall and the first portion of the second sidewall are each spaced apart from a first face of the disc, and wherein the second portion of the first sidewall and the second portion of the second sidewall are each spaced apart from a second face of the disc.

11. The disc according to claim 10, wherein the first direction and the second direction are directions substantially parallel to the first and second faces of the disc.

12. A disc comprising: a plurality of fixing means for mounting detachably mountable carrier plates, each carrier plate with abrasive elements, to a grinding side of the disc, each fixing means having a specific fixing geometry; and a plurality of at least four securing holes configured to receive a fastener for tightening the disc onto a grinding machine, the securing holes being positioned symmetrically about the disc; wherein the plurality of fixing means comprise a first set of a plurality of at least four fixing means and a second set of a plurality of at least four fixing means: the first set of fixing means disposed at a first outer row at a first predetermined radial distance from a center of the disc that passes through each of the first set of fixing means, and the second set of fixing means disposed at a second inner row at a second predetermined radial distance from the center of the disc that passes through each of the first set of fixing means, said second predetermined distance being shorter than the first predetermined distance; wherein each fixing means of the first and second sets of fixing means includes an elongated groove in the disc extending through an entire thickness of the disc; wherein each elongated groove extends through the entire thickness of the disc and comprises a first end lacing an outer circumference of the disc, a second end opposite the first end and facing the center of the disc, a first sidewall, and a second sidewall; wherein the first set of fixing means and the second set of fixing means have an equal number of elongated grooves disposed equidistant around the disc, each elongate groove of each fixing means of the second set of fixing means extending in a direction from the center toward an outer circumference of the disc that bisects a circular arc length between the being disposed along a circle defined by the first predetermined radial distance, wherein each securing hole is evenly spaced between an adjacent elongated groove of the first set of fixing means and an adjacent elongated groove of the second set of fixing means; and wherein each securing hole is diametrically opposed to another securing hole through the center of the disc.

13. The disc according to claim 9, wherein the second end of each groove of the first set of fixing means is closed, and wherein the second end of each groove of the second set of fixing means opens up into the opening at the center of the disc.

14. The disc according to claim 12, wherein the second end of at least one groove opens upon into an opening at the center of the disc.

15. The disc according to claim 14, wherein a slope of the first sidewall extends in a first direction over a first portion of the first sidewall and changes to a second direction over a second portion of the first sidewall, and wherein a slope of the second sidewall extends in the second direction over a first portion of the second sidewall and changes to the first direction over a second portion of the second sidewall to provide a female coupling adapted for corresponding male couplings of the carrier plates.

16. The disc according to claim 15, wherein the first portion of the first sidewall and the first portion of the second sidewall extend from a First face of the disc to a middle of the disc, and wherein the second portion of the first sidewall and the second portion of the second sidewall extend from a second face of the disc to the middle of the disc.

17. The disc according to claim 15, wherein the first portion of the first sidewall and the first portion of the second sidewall are each spaced apart from a first face of the disc, and wherein the second portion of the first sidewall and the second portion of the second sidewall are each spaced apart from a second face of the disc.

18. The disc according to claim 17, wherein the first direction and the second direction are directions substantially parallel to the first and second faces of the disc.

* * * * *